US010232965B2

(12) United States Patent
Béland

(10) Patent No.: US 10,232,965 B2
(45) Date of Patent: Mar. 19, 2019

(54) BOTTLE TRANSFER APPARATUS

(71) Applicant: Gérard Béland, Tecumseh (CA)

(72) Inventor: Gérard Béland, Tecumseh (CA)

( * ) Notice: Subject to any disclaimer, the term of this patent is extended or adjusted under 35 U.S.C. 154(b) by 0 days.

(21) Appl. No.: 15/936,254

(22) Filed: Mar. 26, 2018

(65) Prior Publication Data

US 2018/0282004 A1 Oct. 4, 2018

Related U.S. Application Data

(60) Provisional application No. 62/480,481, filed on Apr. 2, 2017.

(51) Int. Cl.
*B65B 21/18* (2006.01)

(52) U.S. Cl.
CPC ..... *B65B 21/18* (2013.01)

(58) Field of Classification Search
CPC ..... B65D 71/50; B65D 67/02; B65B 21/18
See application file for complete search history.

(56) References Cited

U.S. PATENT DOCUMENTS

| | | | | | |
|---|---|---|---|---|---|
| 5,168,990 | A * | 12/1992 | Johnson | B65D 71/50 | 206/151 |
| 5,188,413 | A * | 2/1993 | Nathan | B65D 71/50 | 206/151 |
| 5,882,057 | A * | 3/1999 | Fahy | B65D 71/50 | 294/159 |
| 2007/0182177 | A1* | 8/2007 | Riness | B65G 7/12 | 294/15 |
| 2011/0042986 | A1* | 2/2011 | Karacan | B65D 71/50 | 294/87.28 |
| 2011/0109110 | A1* | 5/2011 | Sarda | B65G 47/847 | 294/99.1 |
| 2014/0377049 | A1* | 12/2014 | Girtman | B65G 47/907 | 414/800 |

* cited by examiner

*Primary Examiner* — Stephen A Vu
(74) *Attorney, Agent, or Firm* — Mila Shvartsman

(57) ABSTRACT

The present invention relates to a device for transferring a plurality of bottles provided with chimes from a box to a storage facility. The device has a handle adjacent to bottle engagement fingers forming slots or gaps between the fingers to scoop the plurality of bottles and transfer the bottles into a designated storage facility such as a refrigerator. The bottle engagement fingers slidingly engage the bottles under their chimes, the user lifts the scooped bottles using the handle, transferring and slidingly unloading the bottles into the storage facility.

4 Claims, 3 Drawing Sheets

BOTTLE TRANSFER APPARATUS

This application claims priority of U.S. Provisional application No. 62/480,481 filed on Apr. 2, 2017. The present invention relates to an apparatus for transferring bottles out of a box. More specifically, the present apparatus is adapted to transfer bottles with chimes (a narrowing or groove between the bottle's head and neck) from a box to another location such as a refrigerator.

This invention will save labor, time, energy and can prevent repetitive strain injuries associated with handling of bottles.

BACKGROUND

Transferring bottles out of a box is a laborious and time-consuming process. Transferring bottles into a refrigerator is also energy-wasteful due to the fact that the refrigerator door must be kept open during the process.

The present invention is designed to expedite and simplify transferring bottles out of a box into a refrigerator or to another location. Instead of moving one bottle at a time, this invention allows the user to pick up and move four bottles at a time.

Not only does this invention save time for the user, it also saves energy because the refrigerator door does not need to remain open for as long. In some establishments, the refrigerator is located at the floor level below a bar, and the staff has to strain to bend over or kneel to transfer bottles from boxes into the refrigerator.

There is known U.S. Pat. No. 2,420,191 for a similar invention to carry a plurality of bottles in one hand. However, U.S. Pat. No. 2,420,191 is not suited to transfer bottles out of a box into a refrigerator because the handle is over the top of the bottle heads. The present invention has a handle that is purposely adjacent to the bottle heads so that the user can deliver the bottles into the furthest corner of the refrigerator. This would more difficult or impossible with U.S. Pat. No. 2,420,191.

There is also known U.S. Pat. No. 2,426,750 for a Bottle Carrier that permits to carry several bottles in one hand. U.S. Pat. No. 2,426,750 is not like the present invention, and requires each bottle to be threaded into the slot one by one. The present invention allows to quickly scoop and place a plurality of bottles without needing to thread each one into the apparatus like U.S. Pat. No. 2,426,750.

OBJECT OF THE PRESENT INVENTION

The object of the present invention is to expedite transfer of bottles from a box to another location such as a refrigerator. This invention works with any bottle that has a chime. A chime is a narrowing between a bottle's head and neck. In cross-section of a bottle's neck, a chime resembles a groove.

The present invention comprises a handle adjacent to a bottle-engagement means. In the preferred embodiment, the bottle-engagement means comprises three fingers that form two slots or gaps. These slots or gaps are wide enough to fit a bottle's chime, but narrower than the bottle's head and neck, allowing a bottle to depend or hang from the bottle-engagement means by the head.

A user can simply scoop a plurality of bottles out of a box by sliding the bottle-engagement means onto the chimes and lifting the bottles out of the box by the handle. Once lifted, the bottles will hang by their necks, and the user can transfer them into a refrigerator. Placing the bottles on the refrigerator shelf so that the shelf supports the bottles, the user slides out the bottle-engagement means and the bottles are automatically organized inside the refrigerator just as they were organized in the box. Thus, transferring bottles is expedited, and the refrigerator door can be closed quicker to save energy.

In the preferred embodiment, the bottle-engagement means comprises two slots each accommodating two bottles, for a total of four bottles. This embodiment works for bottles packaged in a square configuration. It is possible to have only one slot for water bottles that are not packaged in a square configuration (e.g. "offset" or "staggered" packaging). In tests, there was substantial time and energy saving in the transfer of a plurality of bottles.

DETAILED DESCRIPTION OF THE PREFERRED EMBODIMENT

The present invention relates to an apparatus to transfer bottles out of a packaging to another location. This location may be a shelf, refrigerator, or any other location where the bottles have to be removed out of their packaging.

This invention will be very useful in situations where a lot of bottles have to be transferred in the shortest amount of time. It will save time, prevent repetitive strain injuries, allow users with arthritis to perform tasks that would otherwise be impossible, and save energy. The preferred embodiment is simple to manufacture with no moving parts, and can be used with any bottle that has a chime.

Every day, staff working at bars, pubs, taverns and restaurants must unload many boxes of bottles into storage facilities such as refrigerators so that patrons can enjoy a cold beverage. This work is tedious, time-consuming, and labor-intensive. A person has to upwardly lift each bottle out of the box, reach inside the refrigerator and place the bottle on the shelf. Often times, this task has to be done on one's knees since many refrigerators are under bars, at the floor level. Also, the lost energy of an open refrigerator door is substantial.

Figure 1:
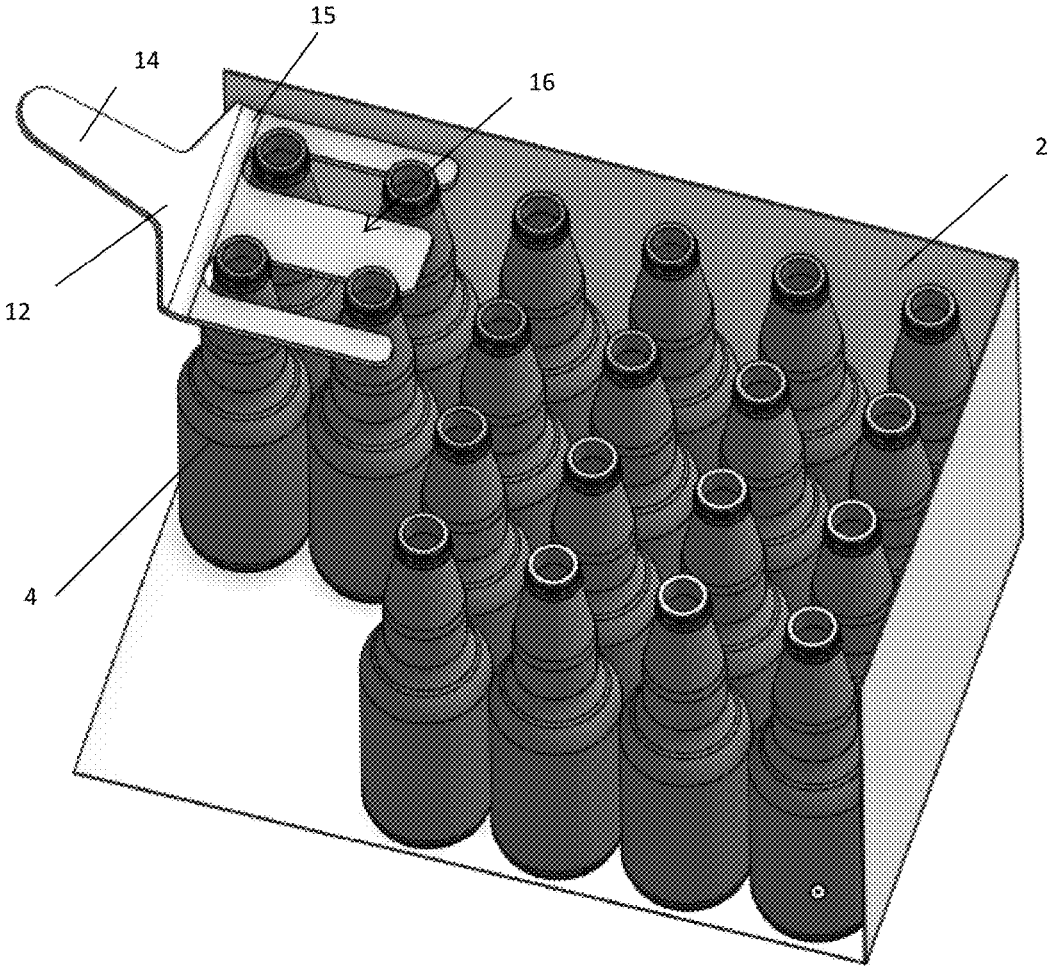
FIG. 1 shows a perspective view of the present invention in use with a box of bottles.

Referring now to figures, FIG. 1 shows a perspective view of the preferred embodiment of the present invention in use. Bottles of beer 4, transported in a box 2, are transferred to another location by bottle loader 12. Loader 12 comprises a handle 14 adjacent to bottle engagement means 16. Body of loader 12 has a fork-like configuration comprising a handle 14 connected to a base portion 15 having a fork-like bottle engagement arrangement, including outer fingers 20 and 21 and central finger 22. A handle 14 is angled in relationship to said base portion 15 under a pre-determined angle (see FIG. 3).

Figure 2:
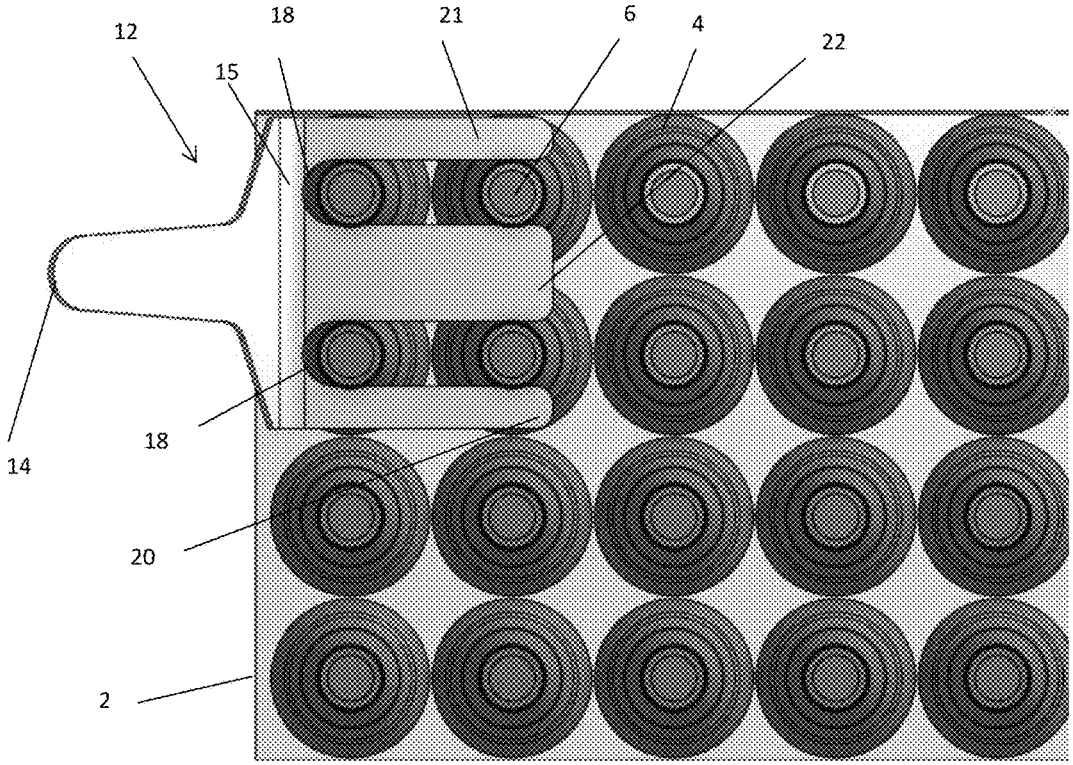
FIG. 2 shows a top view of FIG. 1.

Referring to FIG. 2, the preferred embodiment's loader 12's bottle engagement means 16 comprises two outer fingers 20 and 21, and one central finger 22. Slots or gaps 18 are created between outer finger 20 and central finger 22 and between outer finger 21 and central finger 22. Slot 18 is of a width that is wider than bottle 4's chime 10 but narrower than a bottle's head 6 or neck 8. The spacing between slots 18 is substantially identical to the industry standard spacing between bottles 4 inside box 2.

Figure 3:
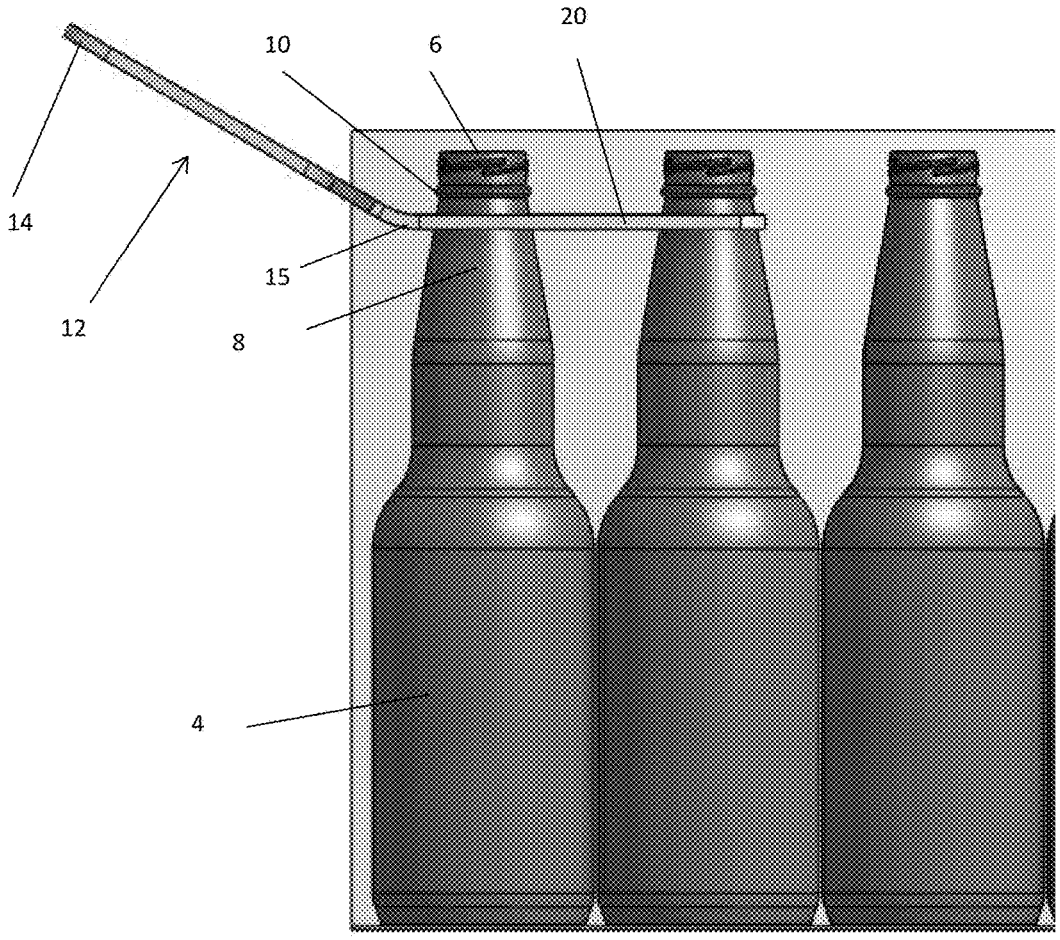
FIG. 3 shows a side view of FIG. 1.

Referring to FIG. 3, bottle chime 10 comprises a groove formed by a wider bottle head 6 and bottle neck 8. Bottle engagement means 16 slides onto chime 10 and adapted to suspend bottles 4 by heads 6 that cannot slip through slots 18 due to the fact that heads 6 are wider than chimes 10, and slots 18 are narrower than heads 6.

In operation, a user grabs handle 14 of loader 12 and slips bottle engagement means 16's slots 18 onto chimes 10, below bottles 4's heads 6, and above bottles 4's necks 8. Bottle 4's chime 10 is narrower than head 6 and neck 8.

Due to the fact that slots 18 correspond to the orientation of bottles 4 inside box 2, bottle engagement means 16 easily slides into the chimes 10 of four bottles 4. User lifts loader 12 upwardly by handle 14, thereby lifting four bottles 4 that are engaged in bottle engagement means 16. Since heads 6 are wider than chimes 10, bottles 4 are suspended from slots 18, which are narrower than heads 6. User then tilts loader 12 slightly backwards so that bottles 4 do not slip out of slots 18 during transport, and the strain of the weight of the bottles is supported by fingers 20, 21 and 22.

As long as user keeps loader 12 tilted slightly backwards, bottles 4 will remain suspended from bottle engagement means 16. User can maneuver loader 12 to a desired destination for bottles 4 via handle 14. Once bottles 4 reach the desired destination, user can lower loader 12 so that bottles 4 are supported by a shelf or surface where the bottles 4 will remain. User tilts loader 12 slightly forwards to relieve the strain of the weight of bottles 4 on fingers 20, 21 and 22 and can slide bottle engagement means 16 backwards off chimes 10. Bottles 4 will remain in place, organized as they were in box 2. User repeats this process with loader 12 until all bottles 4 have been transferred.

As seen on FIG. 1, handle 14 is located at one distal end of loader 12, and bottle engagement means 16 is at the other distal end of loader 12. This configuration results in an important feature of the present invention, being its ability to transfer bottles 4 in a confined storage space. Considering that handle 14 is at a distal end of loader 12, the clearance required between the tops of bottle heads 6 and the ceiling of the storage shelves is as little as 0.75 inches. The difference between Johnson's U.S. Pat. No. 5,168,990 and the present invention is that to place bottles into a storage space, Johnson requires a clearance more than 0.75 inches above the tops of the bottle heads to accommodate a user's hand holding Johnson's bar 11 or handle 39. The present invention does not need clearance over 0.75 inches between the tops of the bottles and the ceiling of the storage space because unlike Johnson the present invention's handle 14 does not necessarily need to enter the storage space to transfer bottles 4.

The invention claimed is:

1. A device for transferring a plurality of bottles provided with chimes from a box to a storage facility comprising:

a body comprising a first distal end opposite to a second distal end, wherein said first distal end having a bottle engagement fork-shaped configuration and said second distal end having a handle, said bottle engagement fork-shaped configuration has a base portion and at least three bottle engagement fingers extending from said base portion, wherein said base portion further being connected to said handle, said bottle engagement fork-shaped configuration defining at least two slots or gaps formed between said bottle engagement fingers, wherein each of said slots or gaps configured to accommodate at least two bottles abutting each other, wherein said slots or gaps are wide enough to fit a neck on each of said at least two bottles, but narrower than a head on each of said at least two bottles, thus allowing said at least two bottles to depend or hang from said bottle engagement fingers when in use, said bottle engagement fingers are adapted to horizontally scoop said at least two bottles from said box by one forward horizontal movement of said handle and to transfer said at least two bottles into said designated storage facility, wherein said bottle engagement fingers are adapted to slidingly engage said bottles under said bottle chimes, lifting said scooped bottles by said handle, transferring and slidingly unloading in one horizontal movement said bottles from said box into said storage facility, and wherein said device is adapted to transfer said bottles in a storage facility with a vertical clearance above said head of each of said bottles.

2. The device for transferring plurality of bottles provided with chimes according to claim 1, wherein said at least three bottle engagement fingers comprise two outer fingers and one central finger extending between said two outer fingers, forming said two slots or gaps.

3. A device for transferring a plurality of bottles provided with chimes from a box to a storage facility comprising:

a body comprising a first distal end opposite to a second distal end, wherein said first distal end having a bottle engagement fork and said second distal end having a handle, said bottle engagement fork has a base portion and at least three bottle engagement fingers extending from said base portion, wherein said base portion further being connected to said handle, said bottle engagement fork defining at least two slots or gaps formed between said bottle engagement fingers, wherein each of said slots or gaps configured to accommodate at least two bottles abutting each other, wherein said slots or gaps are wide enough to fit a neck on each of said at least two bottles, but narrower than ahead on each of said at least two bottles, thus allowing said at least two bottles to depend or hang from said bottle engagement fingers when in use, said bottle engagement fingers are adapted to horizontally scoop said at least two bottles from said box by one forward horizontal movement of said handle and to transfer said at least two bottles into said designated storage facility, wherein said bottle engagement fingers are adapted to slidingly engage said bottles under said bottle chimes, lifting said scooped bottles by said handle, transferring and slidingly unloading in one horizontal movement said bottles from said box into said storage facility, and wherein said device is adapted to transfer said bottles in a storage facility with a vertical clearance above said head of each of said bottles, said handle being angled to a horizontal plane relative to said base portion.

4. The device for transferring plurality of bottles provided with chimes according to claim 3, wherein said at least three bottle engagement fingers comprise two outer fingers and one central finger extending between said two outer fingers, forming said two slots or gaps.

* * * * *